US011220413B2

(12) United States Patent
Green et al.

(10) Patent No.: US 11,220,413 B2
(45) Date of Patent: Jan. 11, 2022

(54) WIRE ROPE COUPLING FOR ELEVATOR

(71) Applicant: Draka Elevator Products Inc., Rocky Mount, NC (US)

(72) Inventors: Dillard Hairston Green, Nashville, NC (US); Johannes Friedrich Richard Güntsch, Tettau (DE)

(73) Assignee: Draka Elevator Products Inc., Rocky Mount, NC (US)

( * ) Notice: Subject to any disclaimer, the term of this patent is extended or adjusted under 35 U.S.C. 154(b) by 245 days.

(21) Appl. No.: 16/504,993

(22) Filed: Jul. 8, 2019

(65) Prior Publication Data

US 2020/0039792 A1 Feb. 6, 2020

Related U.S. Application Data

(60) Provisional application No. 62/712,666, filed on Jul. 31, 2018.

(51) Int. Cl.
*B66B 7/10* (2006.01)

(52) U.S. Cl.
CPC ..... *B66B 7/10* (2013.01); *D07B 2201/1016* (2013.01)

(58) Field of Classification Search
CPC ..... B66B 7/08; B66B 7/068; B66B 7/10
See application file for complete search history.

(56) References Cited

U.S. PATENT DOCUMENTS 1,952,068 A * 3/1934 Hill ..... B66B 7/1269 184/21
6,990,761 B1 1/2006 Cox
8,544,912 B1 10/2013 Matthews
2008/0121170 A1 5/2008 Larsen et al.
2014/0083802 A1* 3/2014 Ko ..... B66B 7/10 187/265
2018/0251350 A1 9/2018 Ijadi-Maghsoodi et al.
(Continued)

FOREIGN PATENT DOCUMENTS

DE 202015004045 U1 9/2015
DE 202016103553 U1 * 10/2016 ..... B66B 7/068
(Continued)

OTHER PUBLICATIONS

Grainger Eye and Eye Wire Rope Slings Industrial Supply Product Catalogue.*
(Continued)

*Primary Examiner* — Diem M Tran
(74) *Attorney, Agent, or Firm* — Ulmer & Berne LLP

(57) ABSTRACT

An elevator assembly includes an elevator cabin, a counterweight, a compensating cable and a means for suspending the compensating cable from the elevator cabin. The compensating cable includes a proximal end and a distal end. The proximal end is coupled with the elevator cabin and the distal end is coupled with the counterweight. The means for suspending the compensating cable is coupled with the elevator cabin and is further coupled with the compensating cable adjacent the proximal end of the compensating cable. The compensating cable has an elastic deformation limit. The means for suspending the compensating cable has a tensile strength that is less than the elastic deformation limit of the compensating cable.

22 Claims, 3 Drawing Sheets

(56) References Cited

U.S. PATENT DOCUMENTS

| | | | | |
|---|---|---|---|---|
| 2019/0011657 | A1 | 1/2019 | Baker et al. | |
| 2019/0337758 | A1* | 11/2019 | Murata | B66B 5/005 |

FOREIGN PATENT DOCUMENTS

| | | | |
|---|---|---|---|
| WO | 02/084018 | A1 | 10/2002 |
| WO | 2012146780 | A1 | 11/2012 |

OTHER PUBLICATIONS

Garant Service; Steel wire rope products @ Garant Service; available at https://www.youtube.com/watch?v=0WXmKo3qHLk; published on Oct. 15, 2013; 1 page.

Premier Lifting & Safety; Product information for 1 Tonne Wire Rope Sling (Large Thimble Eyes); available at https://www.premierlifting.com/Catalogue/Entertainment-Rigging/Truss-Steels/1-Tonne-Wire-Rope-Sling-Large-Thimble-Eyes-; web page copyright date 2019; 2 pages.

Premier Lifting & Safety; Product information for 1 Tonne Wire Rope Sling (Large Thimble Eyes); available at least as of Feb. 26, 2017 at https://web.archive.org/web/20170226081156/https://www.premierlifting.com/Catalogue/Entertainment-Rigging/Truss-Steels/1-Tonne-Wire-Rope-Sling-Large-Thimble-Eyes-; 2 pages.

Pfeifer-Drako; Elevator Products—Steel Wire Ropes in Elevators, Dec. 2017; available at https://www.pfeifer.info/out/assets/PFEIFER-DRAKO_STEEL-WIRE-ROPES.PDF; 40 pages.

* cited by examiner

WIRE ROPE COUPLING FOR ELEVATOR

REFERENCE TO RELATED APPLICATION

This application claims priority of U.S. provisional patent application Ser. No. 62/712,666, entitled Wire Rope Coupling for Elevator, filed Jul. 31, 2018 and hereby incorporates this provisional patent application by reference herein in its entirety.

TECHNICAL FIELD

The articles and methods described below generally relate to a wire rope coupling for supporting a compensating cable beneath an elevator cabin.

BACKGROUND

Elevators typically include compensating chains, cables, or ropes that provide balance to the weight of suspension means. One example of a conventional elevator assembly is illustrated in FIG. 1 and is shown to include an elevator cabin 10 and a compensating cable 12. The compensating cable (or chain) 12 is coupled at a proximal end 14 to the elevator cabin 10 and at a distal end 16 to a counterweight 18 to offset the weight of a hoist rope 20 as the elevator cabin 10 travels vertically.

Another example of a conventional elevator assembly is illustrated in FIG. 2 and is shown to include an elevator cabin 110 and a compensating cable 112. A proximal end 114 of the compensating cable 112 is coupled with the elevator cabin 110 by a support bracket 122. A support assembly 124 is coupled with a portion of the compensating cable 112 that is adjacent to the proximal end 114 and facilitates support of the compensating cable 112 with respect to the elevator cabin 110. The support assembly 124 includes a mesh grip 126, an 'S' hook 128, and a U-bolt 130 attached to the elevator cabin 110. The mesh grip 126 grasps the compensating cable 112 and can be coupled to the 'S' hook 128 which is coupled to the U-bolt 130. The 'S' hook 128 serves as a mechanical fuse during elevator operation and is thus designed to be the weakest component of the support assembly 124. As such, in the event the compensating cable 112 becomes lodged on an obstruction, the 'S' hook 128 will release prior to reaching tensile forces sufficient to inflict permanent damage to the remaining components of the system. A pullout switch 132 is attached to the mesh grip 126 such that if the 'S' hook 128 releases the mesh grip 126, the mesh grip 126 will pull the pullout switch 132 to activate an alarm or change the state of elevator operation. FIG. 3 illustrates another example of a conventional elevator assembly that is similar to, or the same in many respects as, the conventional elevator assembly illustrated in FIG. 2.

PCT Patent App. Pub. No. WO 2002/084018 A1 describes safety ropes in two embodiments. According to the first embodiment, there are one or more auxiliary strands (2, 7, 13) beside the main strands (3, 5, 6, 9-12), of larger stretching coefficient. When the rope (1, 4, 8) breaks, those strands (2, 7, 13) break last, and in this way prevent a jerk and a strike that would be caused by broken ends of the main strands (3, 5, 6, 9-12). The auxiliary strand can be interlaced with the main strands in several different ways. According to the other embodiment, a double loop (14) is made consisting of the main rope (15) that is twisted in loops (16, 17) at the ends. Parallel with the main rope (15), a longer and thinner auxiliary rope (18) is interlaced by knots (19). The auxiliary rope (18) will, when the main rope (15) is overloaded and breaks, break last and in that way soothe the strike, which could cause an accident. Double loops are connected at the ends of the main ropes for mooring of ships and other mobile objects.

U.S. Pat. No. 8,544,912 B1 describes a lifting sling assembly comprising a centering collar element forming a concentric sleeve around a central concavity, a centering housing element, a wire rope, and a lifting support. The centering housing element is defined by a concentric flange member forming a concentric sleeve around the centering housing element. The wire rope is inserted into the central concavity, and the centering collar element is swaged onto the wire rope. The centering collar element, the centering housing element, and the concentric flange member are integrated into a contiguous non-welded assembly such that the wire rope remains rigid within the centering collar member. The lifting support is a mechanical support lifting apparatus.

German Gerbrauchsmusterschrift (Utility Model) DE 20 2015 004 045 U1 describes a stop means with a casing, characterized, that the stop means (3) on a frame structure (1) is detachably fixable, that in longitudinal direction (10) of an axis (12) of the stop means (3) at least partially, a protective sheath (2) is arranged concentrically with the axis (12), that the protective casing (2) at least in the longitudinal direction (10) of the axis (12) of the stop means (3) is movable and the frame structure and positioned concentrically arranged that the protective casing (2) arranged in a concentric with the axis (12), the inner cladding layer (7) and another on the inner coating layer (7), the outer cladding layer (8) is formed.

U.S. Pat. No. 6,990,761 B1 describes that after a wire rope sling is fabricated and the sleeve has been painted and dried, an adhesive type of tag containing all of the information required by ASME B30.9c is applied directly to the sleeve's surface. The sleeve and the tag will then be encased using a transparent casing, coating, or sealant. This will protect the tag from abrasion, the environment, and will ensure a permanent and legible tag.

SUMMARY

In accordance with one embodiment, an elevator assembly comprises, an elevator cabin, a counterweight, a compensating cable, and a wire rope coupling. The compensating cable comprises a proximal end and a distal end. The proximal end is coupled with the elevator cabin and the distal end is coupled with the counterweight. The wire rope coupling comprises a cable having a first end and a second end. The first end is coupled with the elevator cabin and the second end is coupled with the compensating cable adjacent the proximal end of the compensating cable. The compensating cable has an elastic deformation limit. The cable has a tensile strength that is less than the elastic deformation limit of the compensating cable.

In accordance with another embodiment, an elevator assembly comprises, an elevator cabin, a counterweight, a compensating cable, and a means for suspending the compensating cable from the elevator cabin. The compensating cable comprises a proximal end and a distal end. The proximal end is coupled with the elevator cabin and the distal end is coupled with the counterweight. The means for suspending the compensating cable is coupled with the elevator cabin and is further coupled with the compensating cable adjacent the proximal end of the compensating cable. The compensating cable has an elastic deformation limit.

The means for suspending the compensating cable has a tensile strength that is less than the elastic deformation limit of the compensating cable.

BRIEF DESCRIPTION OF THE DRAWINGS

Various embodiments will become better understood with regard to the following description, appended claims and accompanying drawings wherein:

DETAILED DESCRIPTION

Figure 4:
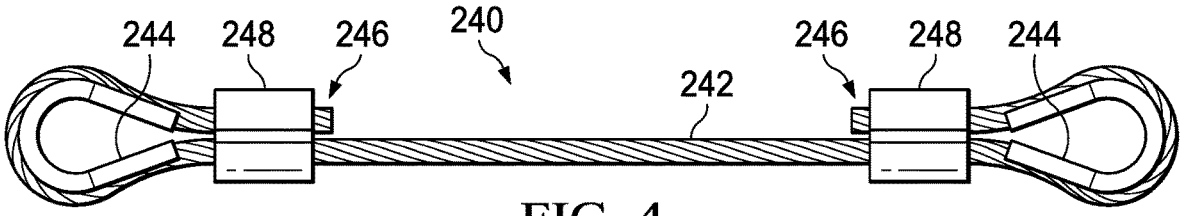
FIG. 4 is a side view of a wire rope coupling for support hardware of an elevator, in accordance with one embodiment.

Embodiments are hereinafter described in detail in connection with the views and examples of FIGS. 4-5, wherein like numbers indicate the same or corresponding elements throughout the views. As illustrated in FIG. 4, a wire rope coupling 240 can include a cable 242, a pair of thimbles 244, and a pair of compression sleeves 248. The cable 242 can include a pair of opposing ends 246 that are each coupled with one of the thimbles 244. In particular, each opposing end 246 can be routed around a respective one of the thimbles 244 and coupled thereto by a respective one of the compression sleeves 248. In one embodiment, the cable 242 can comprise a stranded material, such as, for example, steel, galvanized steel, metal alloy, aramid, steel, metal composite materials, or combinations thereof.

Figure 1:
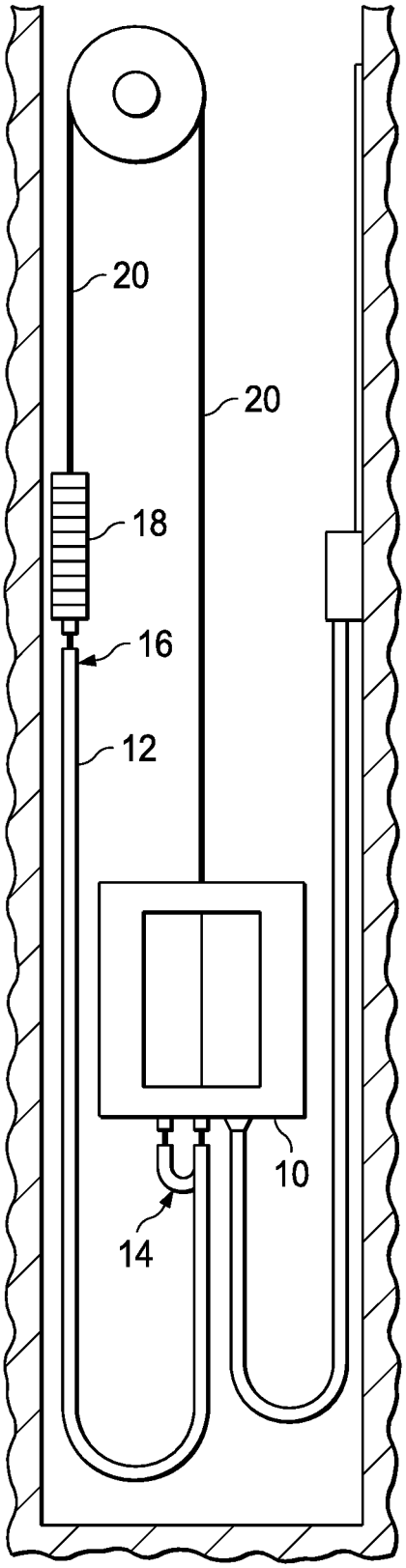
FIG. 1 (PRIOR ART)
FIG. 1 is a front view depicting a conventional elevator assembly.
Figure 2:
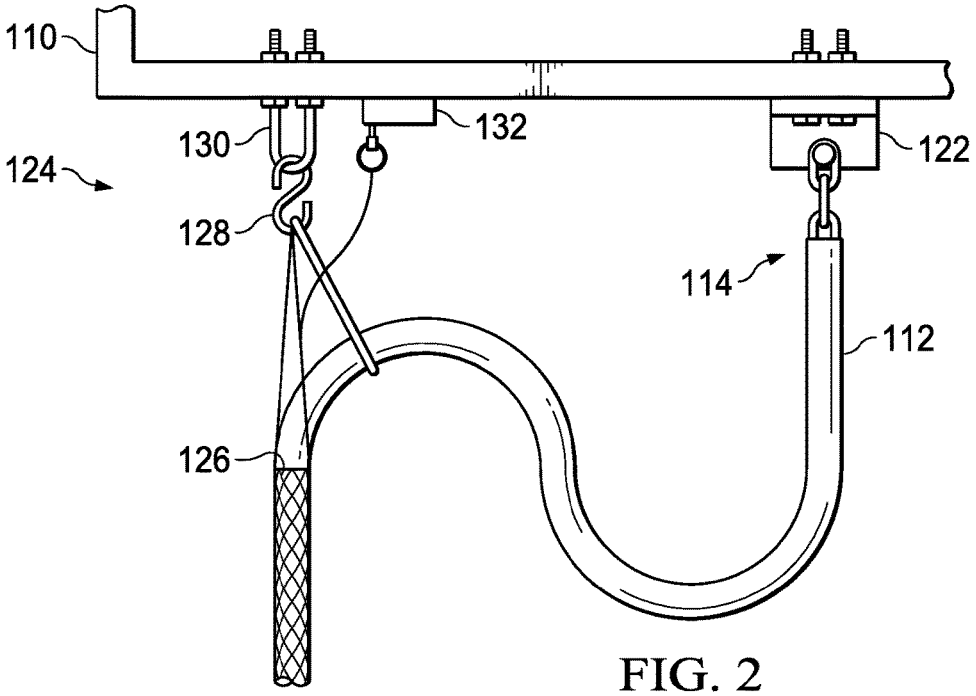
FIG. 2 (PRIOR ART)
FIG. 2 is an enlarged view depicting another conventional elevator assembly.
Figure 3:
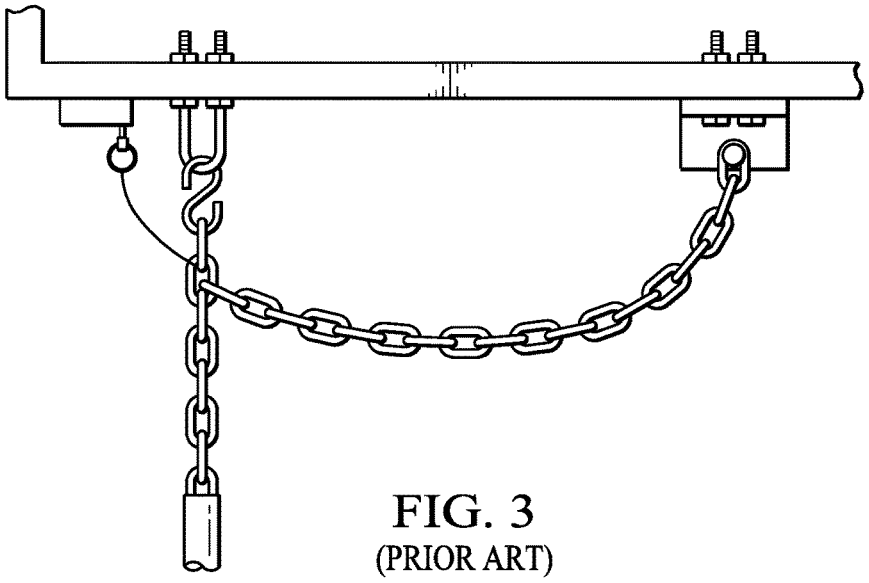
FIG. 3 (PRIOR ART)
FIG. 3 is an enlarged view depicting yet another conventional elevator assembly.
Figure 5:
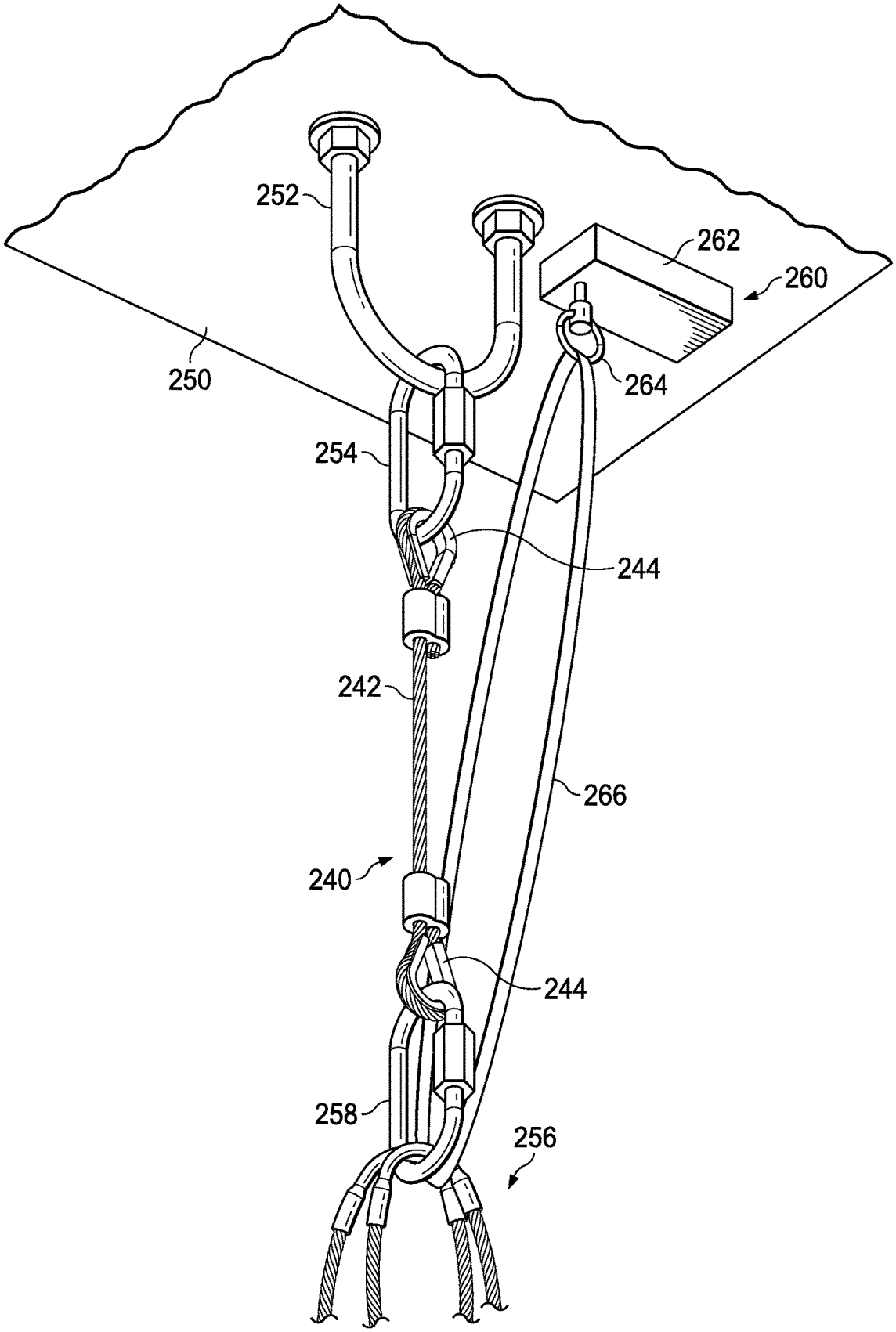
FIG. 5 is a lower isometric view depicting the wire rope coupling of FIG. 4 installed between an elevator cabin and a mesh grip.

Referring now to FIG. 5, the wire rope coupling 240 can facilitate attachment of a compensating cable (not shown) to a bottom of an elevator cabin 250. A U-bolt 252 can be attached to the elevator cabin 250. The wire rope coupling 240 can be attached at one end to the U-bolt 252 via a locking D-ring 254 that is provided through one of the thimbles 244. The wire rope coupling 240 can be attached at the other end to a mesh grip 256 via a locking D-ring 258 that is provided through the other of the thimbles 244. The mesh grip 256 can be attached to the compensating cable (not shown). It is to be appreciated, that although a mesh grip is described, any of a variety of suitable alternative grip arrangements are contemplated, such as, for example, a bare chain (e.g., as illustrated in FIG. 3). It is also to be appreciated that although a pair of locking D-rings (254, 258) are illustrated, any of a variety of suitable alternative couplers can be provided for attaching the wire rope coupling 240 to the mesh grip 256 and/or the elevator cabin 250.

A switch assembly 260 can be associated with the elevator cabin 250 and can include an alarm body 262 and a pullout switch 264 that is selectively removable from the alarm body 262. The pullout switch 264 can facilitate activation of an alarm (e.g., visually or audibly) when removed from the alarm body 262. In one embodiment, the alarm can be local to the switch assembly 260 (e.g., via a light or a speaker). In another embodiment, the alarm can be remote from the switch assembly 260 (e.g., via wireless communication to a remote computing device). The pullout switch 264 can be attached to a grip (e.g., the mesh grip 256 or other connection means) via a tie member 266 such that if the cable 242 breaks, the pullout switch 264 is removed from the alarm body 262 to activate the alarm, thus notifying a technician that the elevator needs to be serviced and/or disabling service of the elevator.

The compensating cable should not be subjected to elastic deformation limit which can be understood to correlate to a maximum tensile force that the compensating cable can withstand before the integrity of the compensating cable system begins to be irreversibly compromised (e.g., an elastic deformation limit) such as, for example, when the compensating cable or any supporting component experiences permanent deformation or damage. The cable 242 of the wire rope coupling 240 can be configured to have a tensile strength that is less than the starting point of the elastic deformation process of the compensating cable such that the cable 242 fails (e.g., breaks) before the tensile forces on the compensating cable reach its elastic deformation starting point.

It is to be appreciated that the material used for the cable 242 can have a maximum fatigue resistance for a specific range of tensile strengths (as determined from a pulling test that generates a stress-strain curve). The particular fatigue resistance and/or tensile strength of the cable 242 can depend on a variety of different variables, such as, for example, cable size, cable length, or the height of the elevator shaft. In one example, the material can have a tensile strength of between about 2,000 pound force (LBF) and about 4,000 LBF. In another example, the material can have a tensile strength of between about 2,300 LBF and about 3,500 LBF. In yet another example, the material can have a tensile strength of between about 2,500 LBF and about 3,200 LBF. For each of these examples, the material can have a diameter that is between about 3 mm and about 7 mm and, in one example, about 4 mm. The materials and configuration for the wire rope coupling 240 can be configured to withstand fatigue testing with a specimen load of between about 265 pounds and about 1,165 pounds for a minimum of about 1,000,000 cycles and preferably about 3,000,000 cycles at 5 Hz. It is to be appreciated that the maximum fatigue resistance and the tensile strength of the wire rope coupling 240 can ultimately depend at least in part upon the material used and the diameter of the material. In one embodiment, each of the thimbles 244 can be formed of a 5/32 inch metal sheet that is formed into a U-shape and defines a groove for receiving the cable 242. It is to be appreciated that any of a variety of suitable alternative materials and/or configurations are contemplated for the cable 242. It is also to be appreciated that although a wire rope coupling 240 is discussed, any of a variety of suitable alternative means for suspending a compensating cable beneath an elevator cabin can be provided.

The wire rope coupling 240 can be configured to provide limited tensile strength (below the plastic deformation limit of other compensating system components) and high fatigue resistance as compared to certain conventional arrangements. For example, the wire rope coupling 240 can have a more well-defined tensile range with high fatigue life that enhances the performance of the wire rope coupling 240 as a mechanical fuse. In addition, the wire rope coupling 240 also can develop wear attributes (e.g., fraying) that can be used to determine replacement intervals as part of a preventive maintenance routine. It is to be appreciated that the wire rope coupling 240 can be utilized in new installations as well as a replacement for conventional arrangements, such as 'S' hooks, in existing sites.

The foregoing description of embodiments and examples has been presented for purposes of illustration and description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent devices by those of ordinary skill in the art. Rather, it is hereby intended that the scope be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. An elevator assembly comprising:
an elevator cabin;
a counterweight;
a compensating cable comprising a proximal end and a distal end, the proximal end being coupled with the elevator cabin and the distal end being coupled with the counterweight;
a wire rope coupling comprising a cable having a first end and a second end, the first end being coupled with the elevator cabin and the second end being coupled with the compensating cable adjacent the proximal end of the compensating cable, wherein:
the compensating cable has an elastic deformation limit; and
the wire rope coupling has a tensile strength that is less than the elastic deformation limit of the compensating cable.

2. The elevator assembly of claim 1 further comprising a grip coupled with the compensating cable adjacent to the proximal end and wherein the second end of the cable is coupled with the compensating cable via the grip.

3. The elevator assembly of claim 2 wherein the grip comprises a mesh grip.

4. The elevator assembly of claim 1 wherein the cable has a diameter of between about 3 mm and about 7 mm.

5. The elevator assembly of claim 4 wherein the diameter is about 4 mm.

6. The elevator assembly of claim 1 wherein the cable has a tensile strength of between about 2,000 pound force and about 4,000 pound force.

7. The elevator assembly of claim 6 wherein the tensile strength is between about 2,300 pound force and about 3,500 pound force.

8. The elevator assembly of claim 7 wherein the tensile strength is between about 2,500 pound force and about 3,200 pound force.

9. The elevator assembly of claim 8 wherein the cable has a diameter of between about 3 mm and about 7 mm.

10. The elevator assembly of claim 9 wherein the diameter is about 4 mm.

11. The elevator assembly of claim 1 wherein the cable is formed of a stranded material.

12. The elevator assembly of claim 11 wherein the stranded material comprises a metal, a metal alloy, an aramid, a composite, or combinations thereof.

13. The elevator assembly of claim 12 wherein the metal alloy comprises steel.

14. The elevator assembly of claim 1 wherein the wire rope coupling further comprises:
a first thimble disposed at the first end of the cable;
a second thimble disposed at the second end of the cable;
a first compression sleeve coupled with the first end of the cable adjacent to the first thimble; and
a second compression sleeve coupled with the second end of the cable adjacent to the second thimble.

15. The elevator assembly of claim 1 further comprising a switch assembly coupled with the elevator cabin and comprising an alarm body and a pullout switch, wherein:
the pullout switch is selectively removable from the alarm body; and
the pullout switch is coupled with the compensating cable.

16. An elevator assembly comprising:
an elevator cabin;
a counterweight;
a compensating cable comprising a proximal end and a distal end, the proximal end being coupled with the elevator cabin and the distal end being coupled with the counterweight;
a means for suspending the compensating cable from the elevator cabin, the means for suspending the compensating cable coupled with the elevator cabin and further coupled with the compensating cable adjacent the proximal end of the compensating cable, wherein:
the compensating cable has an elastic deformation limit; and
the means for suspending the compensating cable has a tensile strength that is less than the elastic deformation limit of the compensating cable.

17. The elevator assembly of claim 16 further comprising a grip coupled with the compensating cable adjacent to the proximal end and wherein the means for suspending the compensating cable is coupled with the compensating cable via the grip.

18. The elevator assembly of claim 17 wherein the grip comprises a mesh grip.

19. The elevator assembly of claim 16 wherein the means for suspending the compensating cable has a tensile strength of between about 2,000 pound force and about 4,000 pound force.

20. The elevator assembly of claim 19 wherein the tensile strength is between about 2,300 pound force and about 3,500 pound force.

21. The elevator assembly of claim 20 wherein the tensile strength is between about 2,500 pound force and about 3,200 pound force.

22. The elevator assembly of claim 16 further comprising a switch assembly coupled with the elevator cabin and comprising an alarm body and a pullout switch, wherein:
the pullout switch is selectively removable from the alarm body; and
the pullout switch is coupled with the compensating cable.

* * * * *